US011358145B2

(12) United States Patent
Joris et al.

(10) Patent No.: US 11,358,145 B2
(45) Date of Patent: Jun. 14, 2022

(54) MICROFLUIDIC CARTRIDGE WITH BUILT-IN SAMPLING DEVICE

(71) Applicant: LUNAPHORE TECHNOLOGIES SA, Tolochenaz (CH)

(72) Inventors: Pierre Joris, Lausanne (CH); Giulia Cappi, Lausanne (CH); Marco Ammann, Lausanne (CH); Marta Comino, Lausanne (CH); Deniz Eroglu, Lausanne (CH); Diego Gabriel Dupouy, Préverenges (CH); Ata Tuna Ciftlik, Morges (CH)

(73) Assignee: LUNAPHORE TECHNOLOGIES SA, Tolochenaz (CH)

( * ) Notice: Subject to any disclaimer, the term of this patent is extended or adjusted under 35 U.S.C. 154(b) by 249 days.

(21) Appl. No.: 16/649,870

(22) PCT Filed: Sep. 19, 2018

(86) PCT No.: PCT/EP2018/075299
§ 371 (c)(1),
(2) Date: Mar. 23, 2020

(87) PCT Pub. No.: WO2019/063375
PCT Pub. Date: Apr. 4, 2019

(65) Prior Publication Data

US 2020/0269241 A1 Aug. 27, 2020

(30) Foreign Application Priority Data

Sep. 26, 2017 (EP) ..... 17193351

(51) Int. Cl.
*B01L 3/00* (2006.01)
*B01L 9/00* (2006.01)

(52) U.S. Cl.
CPC ..... *B01L 3/502738* (2013.01); *B01L 9/527* (2013.01); *B01L 2200/0689* (2013.01);
(Continued)

(58) Field of Classification Search
CPC ..... B01L 2200/0689; B01L 2300/0816; B01L 2300/0819; B01L 2300/0822;
(Continued)

(56) References Cited

U.S. PATENT DOCUMENTS

2005/0013732 A1 1/2005 Battrell et al.
2011/0003330 A1 1/2011 Durack
(Continued)

FOREIGN PATENT DOCUMENTS

WO 2007/093939 8/2007
WO 2013/128322 9/2013

OTHER PUBLICATIONS

Nguyen et al. "Microfluidics-assisted fluorescence in situ hybridization for advantageous human epidermal growth factor receptor 2 assessment in breast cancer" Lab Invest. Jan. 2017;97(1):93-103. doi: 10.1038/labinvest.2016.121. Epub Nov. 28, 2016. PMID: 27892928. (Year: 2017).*

(Continued)

*Primary Examiner* — Jennifer Wecker
*Assistant Examiner* — Jonathan Bortoli
(74) *Attorney, Agent, or Firm* — Nixon & Vanderhye P.C.

(57) ABSTRACT

Microfluidic cartridge (10) comprising a sampling device (30) having a sealing ring (32) arranged to form a microfluidic chamber (31) when a support containing a biological sample is brought into contact with the sealing ring, and a microfluidic network device (13) configured to supply reagents to the microfluidic chamber. The sampling device further comprises inlet and outlet distribution networks (33*a*, 33*b*) in fluid communication with the microfluidic
(Continued)

chamber and a slide holder (35) to guide and position said support containing a biological sample on the sampling device. The microfluidic network device comprises a plurality of reagent inlet channels (18) fluidly connectable to reagent sources, at least one reagent outlet channel (22) fluidly connected to the sampling device inlet distribution network (33*a*), and a plurality of valves (25) operable to selectively connect the inlet channels to the at least one outlet channel. The sampling device (30) and microfluidic network device (13) are formed on a common microfluidic support (12) as a single part.

61 Claims, 7 Drawing Sheets

(52) U.S. Cl.
CPC ..... *B01L 2300/0816* (2013.01); *B01L 2300/0819* (2013.01); *B01L 2300/0861* (2013.01); *B01L 2400/0633* (2013.01)

(58) Field of Classification Search
CPC ..... B01L 2300/0861; B01L 2300/0867; B01L 2300/0877; B01L 2300/0883; B01L 2400/0633; B01L 2400/0655; B01L 3/5027; B01L 3/502738; B01L 9/527
See application file for complete search history.

(56) References Cited

U.S. PATENT DOCUMENTS

2012/0266986 A1 10/2012 Wimberger-Friedl et al.
2017/0189904 A1* 7/2017 Aravanis ..... F16K 99/0015

OTHER PUBLICATIONS

International Search Report and Written Opinion of the ISA for PCT/EP2018/075299, dated Oct. 22, 2018, 16 pages.
Huu Tuan Nguyen et al., "Microfluidics-assisted fluorescence in situ hybridization for advantageous human epidermal growth factor receptor 2 assessment in breast cancer", Laboratory Investigation, Nov. 28, 2016, XP055432231, vol. 97, No. 1, pp. 93-103.
Ciftlik et al., "Microfluidic processor allows rapid HER2 immunohistochemistry of breast carcinomas and significantly reduces ambiguous (2+) read-outs", Proceedings of the National Academy of Sciences of the United States of America, Mar. 11, 2013, vol. 110, No. 14, pp. 5363-5368.

* cited by examiner

MICROFLUIDIC CARTRIDGE WITH BUILT-IN SAMPLING DEVICE

This application is the U.S. national phase of International Application No. PCT/EP2018/075299 filed 19 Sep. 2018, which designated the U.S. and claims priority to EP Patent Application No. 17193351.8 filed 26 Sep. 2017, the entire contents of each of which are hereby incorporated by reference.

The present invention relates to a microfluidic cartridge comprising a built-in sampling device and a microfluidic network device for delivery of reagents to the sampling device. The invention also relates to a biological sample processing system comprising the microfluidic cartridge and a microfluidic cartridge operating system. The present invention is particularly useful for sequential delivery of reagents to the sampling device.

Cartridge-based reagent delivery systems and methods with different actuation schemes and configurations are known. However, many are not versatile as they are suitable only for very specific applications and present different drawbacks.

WO2007093939 discloses a microfluidic cartridge for molecular diagnostic applications with membrane-based actuation for fluid transport. The cartridge requires small volumes of reagents to analyze samples. The cartridge however is not configured for receiving a slide containing samples or to allow low dead volume operation.

US2011003330 discloses a microfluidic device adapted for facilitating cytometry analysis of particles flowing therethrough. The microfluidic device may comprise a chip comprising a plurality of chambers and be designed to sort a predetermined amount of cells into each chamber. The configuration of the device however does not prevent the occurrence of dead volumes.

US2005013732 discloses a microfluidic device for the manipulation, amplification and analysis of fluid samples including, for example, blood platelet bacteria assays and antiglobulin testing. The microfluidic device is operably connected to a cartridge manifold for controlling pumping of fluids and for providing vacuum and pressurized air for cartridge valve actuation. However, the configuration of the device does not prevent the occurrence of cross-contamination which may be critical in applications requiring high specificity and sensitivity.

US2012266986 discloses a microfluidic cartridge for placement onto a parallel pneumatic interface plate of a pneumatic instrument. The cartridge includes a three dimensional fluid channel, in which a fluid is to be transported, and a flexible membrane that is part of an outer surface of the cartridge. The flexible membrane is pneumatically deflectable from a ground state perpendicular to the plane of the flexible membrane in two directions when the cartridge is placed onto the parallel pneumatic interface plate. The configuration of the cartridge has also the disadvantage of being prone to cross-contamination and dead volumes.

It is an object of this invention to provide a microfluidic cartridge allowing sequential multiplex processing of a biological sample fixed on a support with a sequence of reagents that generates accurate and reliable results yet is economical to produce and to use.

It is a specific object of this invention to provide a microfluidic cartridge allowing sequential multiplex processing of a biological tissue sample immobilized on a support such as a microscope slide, with a sequence of reagents that generates accurate and reliable results yet is economical to produce and to use.

It is advantageous to provide a microfluidic cartridge that is compact.

It is advantageous to provide a microfluidic cartridge that reduces the risk of cross contamination and problems associated with dead volumes in microfluidic networks.

It is advantageous to provide a microfluidic cartridge that is versatile and can be used or adapted for different applications.

Another object of this invention is to provide a biological sample processing system comprising a microfluidic cartridge and a micro cartridge operating system for automated processing of a sample of interest fixed on a support.

It is advantageous to provide a biological sample processing system capable of analyzing automatically different type of samples fixed on a support across a wide range of applications.

Objects of the invention have been achieved by providing a microfluidic cartridge according to claim 1.

Objects of the invention have been achieved by providing a biological sample processing system according to claim 16.

Disclosed herein is a microfluidic cartridge comprising a sampling device having a sealing ring arranged to form a microfluidic chamber when a support containing a biological sample fixed thereon is brought into contact with the sealing ring, and a microfluidic network device configured to supply reagents to the microfluidic chamber. The sampling device comprises inlet and outlet distribution networks in fluid communication with the microfluidic chamber and a slide holder to guide and position said support containing a biological sample on the sampling device. The microfluidic network device comprises a plurality of reagent inlet channels fluidly connectable to reagent sources, at least one reagent outlet channel fluidly connected to the sampling device inlet distribution network, and a plurality of valves operable to selectively connect the inlet channels to the at least one outlet channel, wherein the sampling device and microfluidic network device are formed on a common microfluidic support as a single part. The support may for instance be in the form of a microscope slide for positioning under a microscope in the viewing field of a camera or other optical detection system for analysis of the sample reacted with the reagents.

In an embodiment, the microfluidic cartridge further comprises a reagent reservoir body (formed in the microfluidic support containing a plurality of wells configured to be filled with reagents, wherein each well is fluidly connected to a corresponding inlet channel.

In an embodiment, the sampling device comprises a first arrangement of reagents distribution comprising inlet and outlet distribution networks arranged on two opposite sides of the microfluidic chamber and configured to direct flow of reagent(s) inside the microfluidic chamber along a first direction, and a second arrangement of reagents distribution comprising inlet and outlet distribution networks arranged on two other opposite sides of the microfluidic chamber and configured to direct flow of reagent(s) inside the microfluidic chamber in a second direction transverse to the first direction.

In an embodiment, the microfluidic support comprises an integrally formed plastic molded microfluidic board in which the inlet channels, outlet channel, and sampling device inlet and outlet distribution channels are formed.

In an embodiment, at least one reagent outlet channel is a common single outlet channel connected to a plurality of said reagent inlet channels, said outlet channel comprising valve portions and intermediate portions therebetween, wherein the valve portions are adjacent to outlet end portions of the inlet channels and the intermediate portions are fluidly connected to each other in series, and wherein each of said plurality of valves interconnect an outlet end portion of each inlet channel to a corresponding valve portion of the common reagent outlet channel, wherein each valve is switchable between a valve closed position in which fluid communication between a corresponding inlet channel and the reagent common outlet channel is closed, and a valve open position in which fluid communication between said inlet channel and the reagent common outlet channel is open.

In an embodiment, the common reagent outlet channel extends generally in a direction transverse to an outlet end portion of the inlet channels.

In an embodiment, the reagent common outlet channel comprises a first and a second main part which are spaced apart and extend in a direction transverse to an outlet end portion of the inlet channels.

In an embodiment, the microfluidic network device further comprises an external reagent inlet section comprising several reagent inlet couplings for fluidly coupling one or more external reagent inlet channels to external reagent sources.

In an embodiment, the external reagent inlet section is adjacent to a valve section comprising the plurality of valves.

In an embodiment, the valve section is positioned between the external reagent inlet section and the onboard reagent reservoir body.

In an embodiment, the sampling device is positioned adjacent a first end of the microfluidic support.

In an embodiment, the onboard reagent reservoir body is positioned adjacent a second end of the microfluidic support opposite the first end.

In an embodiment, the microfluidic network device further comprises a cartridge outlet, a chamber outlet channel connected to the outlet distribution network of the sampling device, and at least two valves configured to fluidly interconnect respectively the chamber outlet channel or the reagent common outlet channel to the cartridge outlet in order to discharge the reagent residues coming from the microfluidic chamber of the sampling device during sample processing steps or to discharge washing solutions circulating through the reagent common outlet channel during a washing step.

In an embodiment, the microfluidic network device may be at least partly embedded inside the microfluidic board on a first side thereof, while the sealing ring of the sampling device and the onboard reservoir body are mounted on a second side of said microfluidic board opposite the first side.

In an embodiment, a valve section comprises the plurality of valves, the valve section comprising a deflectable membrane layer disposed on the microfluidic board.

Also disclosed herein, is a microbiological sample processing system comprising a microfluidic cartridge as set forth in any of the above embodiments, and a microfluidic cartridge operating system comprising a cartridge receptacle receiving the microfluidic cartridge, a valve interfacing assembly and a reservoir body interfacing assembly, wherein the valve interfacing assembly is operable to selectively actuate each valve to create a fluid communication between a corresponding inlet channel and the reagent outlet channel.

In an embodiment, the reservoir body interfacing assembly is operable to induce flow of a reagent from one or more wells into the microfluidic chamber of the sampling device.

In an embodiment, the reservoir body interfacing assembly comprises a delivery manifold head displaceable relative to the cartridge receptacle from a non-operating configuration to an operating configuration, in which the bottom face of the manifold head lies against the top face of the reservoir body, wherein the manifold head comprises a plurality of actuation lines disposed to be aligned with the plurality of wells.

In an embodiment, the valve interfacing assembly and the body reservoir interfacing assembly are in fluid communication with an external pressure source.

In an embodiment, the valve interfacing assembly may comprise a pressure delivery manifold head displaceable relative to the cartridge receptacle from a non-operating configuration to an operating configuration in which the bottom face of the manifold head lies against the valve section or multiple valve sections of the microfluidic network device, wherein the manifold head comprises a plurality of actuation chambers and corresponding actuation lines in fluid communication with each actuation chamber, the plurality of actuation chambers being disposed such that each chamber encloses the valve inlet and outlet orifices of the corresponding valve, wherein the pressure delivery manifold head is operable to selectively create a negative pressure inside one or more actuation chambers.

In an embodiment, a sealing gasket may be arranged against the bottom face of said pressure delivery manifold head, configured to surround each outlet of the actuation lines to ensure that the manifold head of the second fluidic interfacing assembly is sealingly fitted against the top face of reservoir body when the processing system is in an operating configuration.

In an embodiment, the microfluidic network device may further comprise an external reagent inlet section comprising several reagent inlet couplings for coupling one or more inlet channels to external reagent sources, and wherein the microfluidic cartridge operating system further comprises an external reagent interfacing assembly comprises a reagent delivery manifold head operably connected to external sources of reagents, said reagent delivery manifold head comprising a plurality of reagent delivery lines disposed to be sealingly fitted with the corresponding reagent inlet couplings.

Further objects and advantageous features of the invention will be apparent from the claims, from the detailed description, and annexed drawings, in which:

Figure 5A:
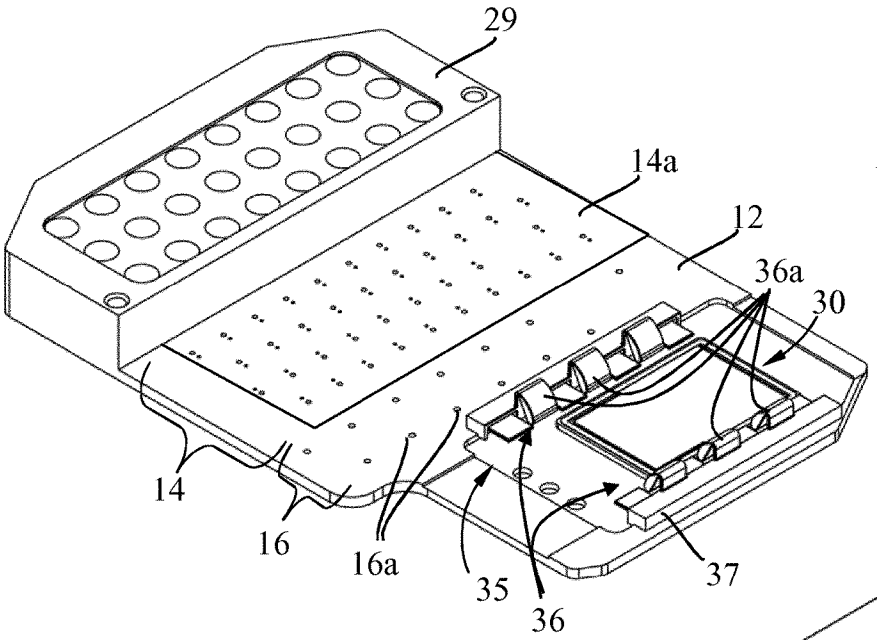
Figure 5B:
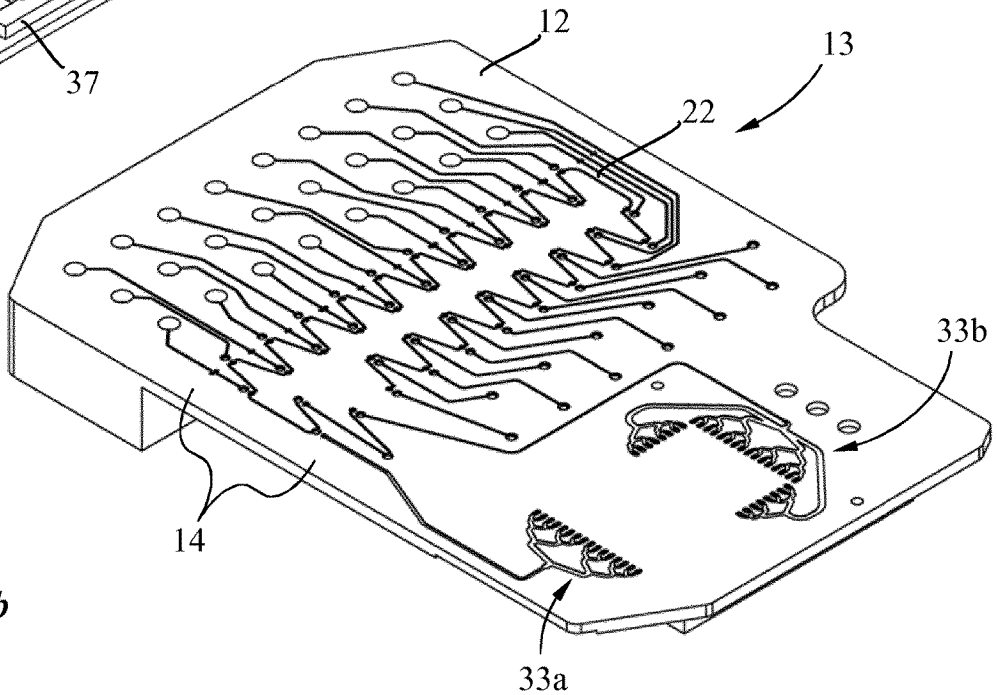
Figure 6A:
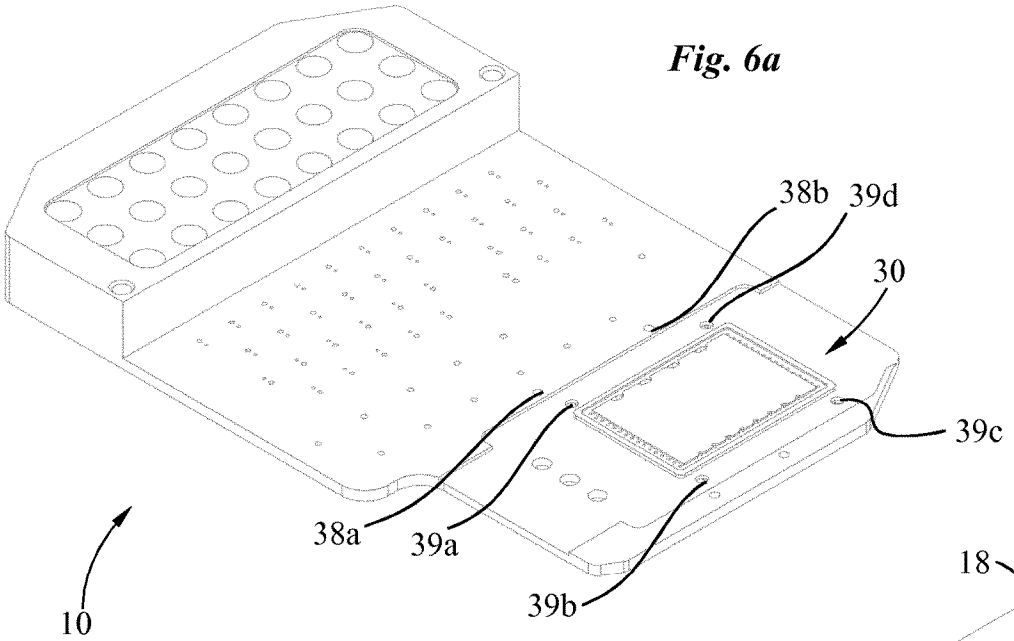
Figure 6B:
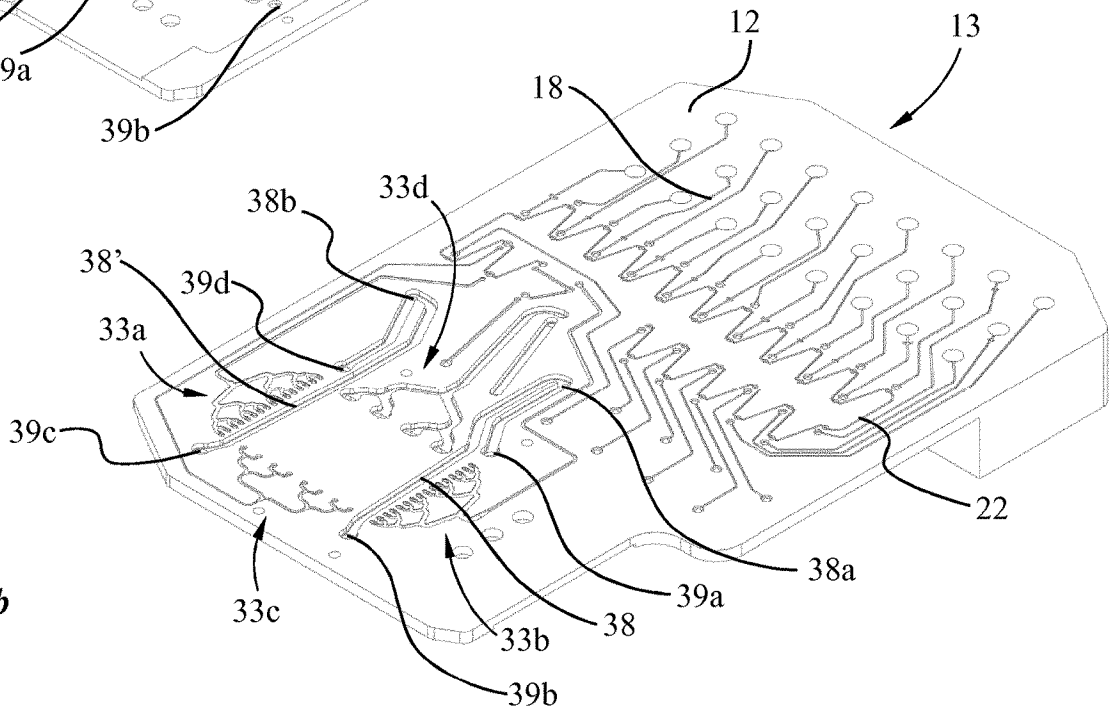
Figure 7:
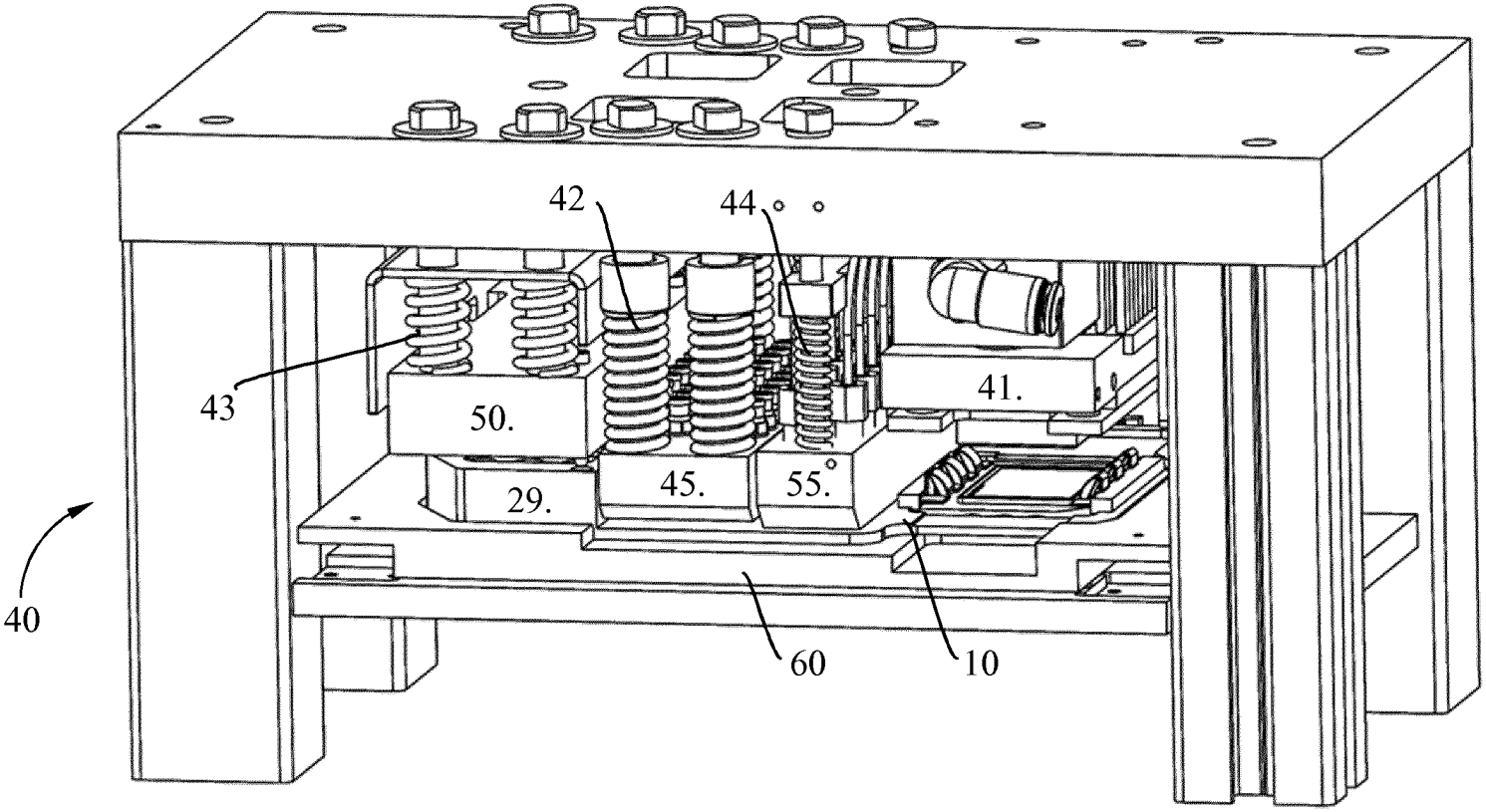
Figure 8B:
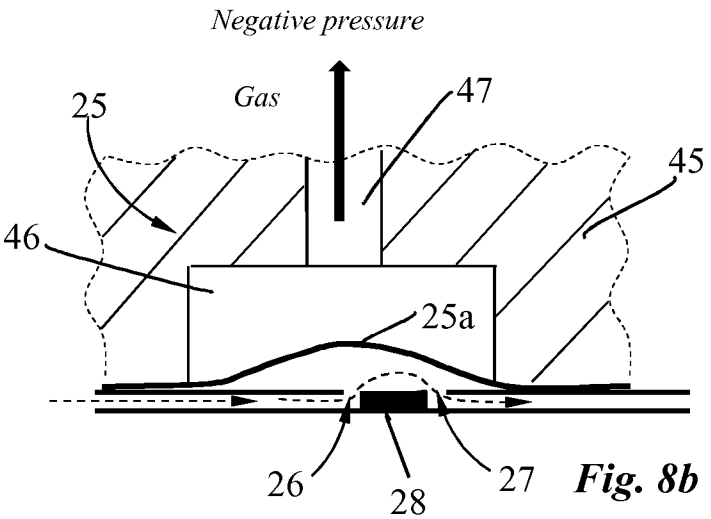
Figure 8A:
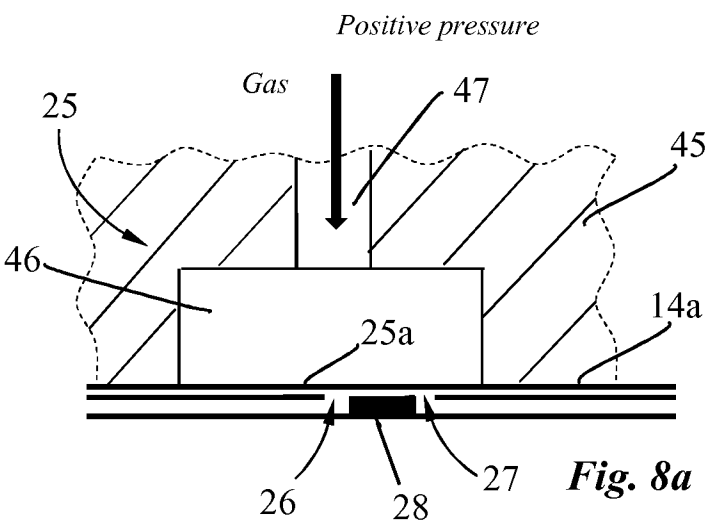
Figure 10:
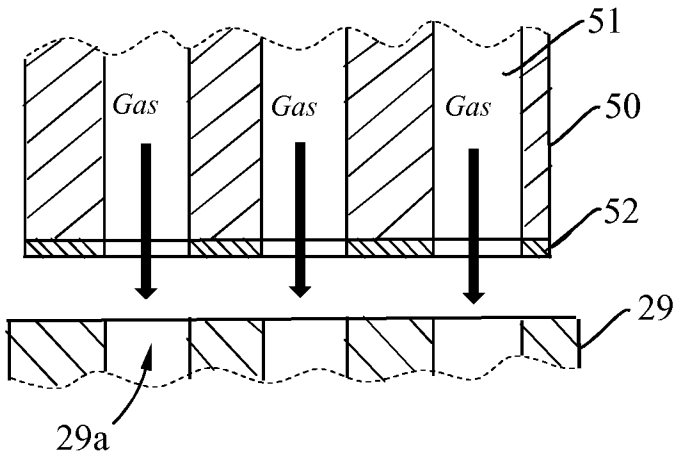
Figure 9:
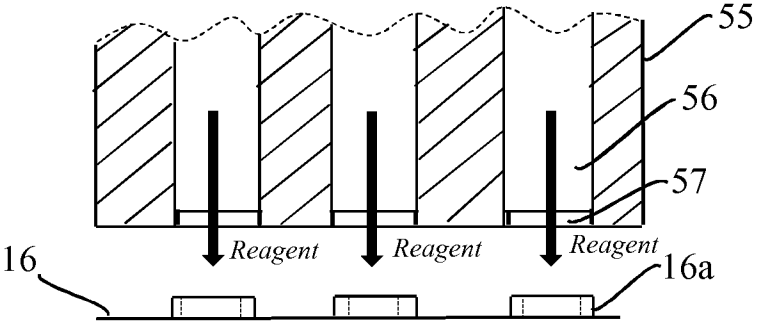

FIGS. 5*a* and 5*b* are top and bottom perspective views of a microfluidic cartridge according to another embodiment;

FIGS. 6*a* and 6*b* are top and bottom perspective views of a microfluidic cartridge according to another embodiment;

FIG. 7 is a perspective view of biological sample processing system according to an embodiment;

FIGS. 8*a* and 8*b* are cross-sectional schematic views of an actuation chamber of a valve interfacing assembly according to an embodiment operably connected to a valve of a microfluidic cartridge in which the valve is respectively in a close and open configuration;

FIG. 9 is a partial cross-sectional schematic view of an external reagent interfacing assembly in relation with an external reagent inlet section of a microfluidic cartridge according to an embodiment; and FIG. 10 is a partial cross-sectional schematic view of a reservoir body interfacing assembly in relation with a reservoir body of a microfluidic cartridge according to an embodiment.

The use of the term "reagent" in the present application is intended to cover a variety of liquids or gases that are used in the microfluidic cartridge for various applications. Reagents may for instance comprise antibodies, imaging probes, washing buffers, chemical reagents, water, saline solutions and other liquids used in the application concerned. Sample liquids are intended to mean liquids that contain samples on which testing is applied, such samples for instance containing biological tissues or other microbiological matter, pollutants, or other substances on which a test on the properties thereof is intended to be carried out by a sampling device downstream of the microfluidic network device.

Sample types fixed (immobilized) on a sample support for use with the microfluidic cartridge include those fixed by cross-linking agents such as whole tissue samples and surgical or needle biopsies of different tissue types including for example breast tissue, lung tissue, tonsils, lymph node tissue, prostate tissue, gut tissue, liver tissue or kidney tissue. The microfluidic cartridge may also be used with tumor samples such as biopsies from breast cancer, lung cancer, prostate cancer, ovarian cancer, colorectal cancer and melanoma or with sample of fluidic nature such as blood or cell smears samples or with samples of microbial nature such as bacteria. The microfluidic cartridge may further be used with samples that are fixed by cross-linking reagents cut into thin sections and subsequently applied to a support/slide.

Figure 1:
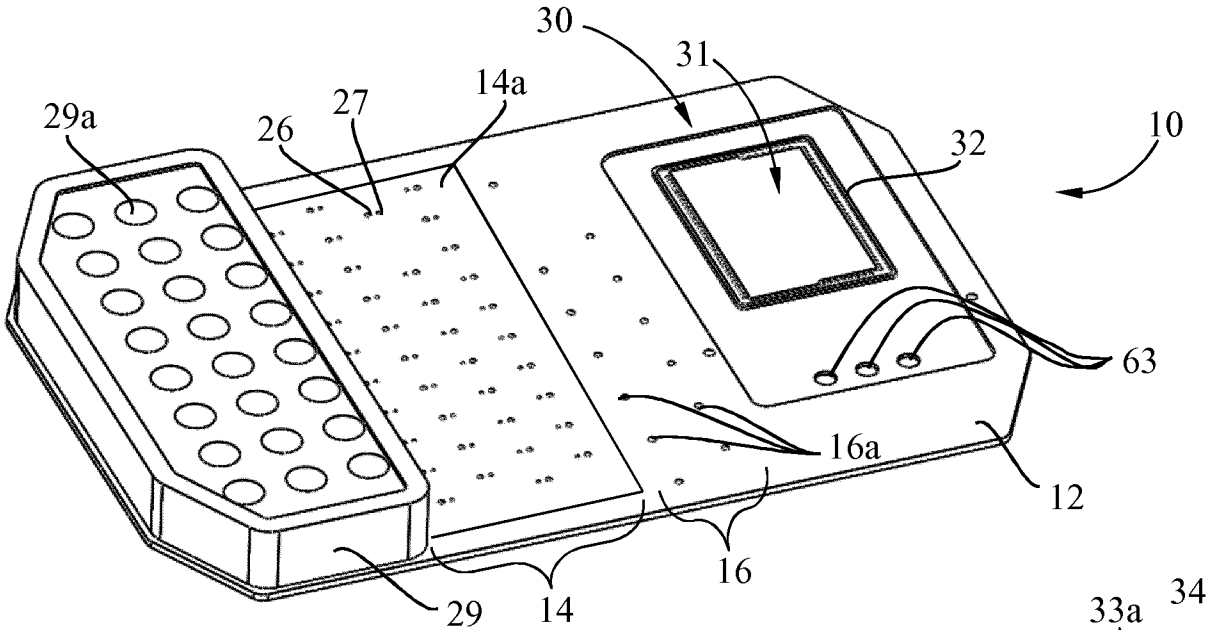
FIG. 1 is a perspective view of a microfluidic cartridge according to an embodiment of the invention.
Figure 2:
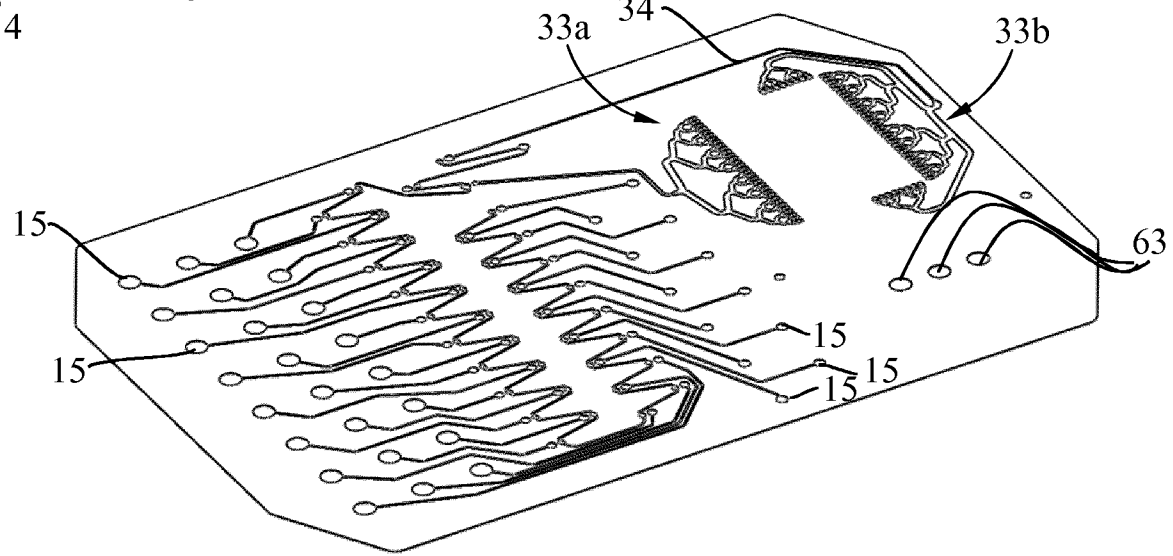
FIG. 2 is a perspective view of a microfluidic network device of the microfluidic cartridge of FIG. 1.

Referring now to the figures, in particular FIGS. 1 and 2, a microfluidic cartridge 10, according to a first aspect of the invention, comprises a reservoir body 29 containing a plurality of wells 29*a* filled with reagents or sample liquids for the applications for which the microfluidic cartridge is intended, a sampling device 30 known per se (for instance as described in WO 2013/128322) comprising a sealing ring 32 arranged to form a microfluidic chamber 31 when a slide containing samples is brought into contact with the sealing ring 32, and a microfluidic network device 13 connected downstream of the reservoir body 29 and upstream of the sampling device 30 to which reagents (antibodies, imaging buffers, washing solutions, etc . . . ) are supplied. The microfluidic network device 13 also comprises reagent inlet coupling 16*a* for connection to external reagent sources such as washing buffers which are usually used in high volumes exceeding the volume capacity of the wells 29*a* of the reservoir body 29.

The volume of each well of the reservoir body ranges preferably from 50 μl to 5 ml, for instance around 200 μl. Fluidic actuation of reagents may be achieved by pressurizing either each well separately or a plurality of wells simultaneously via one or more pressurized sources.

In an embodiment, the reagents supply may be provided on board the cartridge by the plurality of wells 29*a* of the reservoir body 29.

In another embodiment, the reagents supply may be provided by external reagent sources connected via tubing to reagent inlet couplings of the microfluidic network device.

In another embodiment the reagents supply may comprise a combination of reagents on board the cartridge in wells 29*a* of the reservoir body 29 and of external reagent sources connected via tubing to reagent inlet couplings of the microfluidic network device.

In an advantageous embodiment illustrated in FIGS. 5*a* and 5*b*, the microfluidic network device 13 is at least partly embedded inside a microfluidic board 12 or disposed at least on a first side thereof. The sealing ring 32 of the sampling device 30 and the reservoir body 29 are mounted on a second side of the microfluidic board 12 opposite the first side. The sampling device 30 comprises a slide holder 35 having a clamping system 36 in order to maintain a slide containing a biological sample thereon sealingly fitted against the sealing ring 32 to form the bottom side of the microfluidic chamber 31. The clamping system 36 may for instance comprise elastically biasable clips 36*a* supported by guiding rails 37 arranged adjacent opposite sides of the sealing ring 32 to facilitate the positional guiding and holding of a slide against the sealing ring 32. The slide holder 35 is configured to hold a slide at a distance of about 1 mm from the microfluidic board 12. The sample on the slide may also be dewaxed in an open-chamber configuration in order to remove residues which may clog the channels of the microfluidic network device 13 directly from the microfluidic chamber 31.

The microfluidic network device 13 comprises a valve section 14 comprising a plurality of valves 25 (FIGS. 8*a* and 8*b*) and an external reagent inlet section 16 comprising several reagent inlet couplings 16*a* for fluidly coupling one or more inlet channel 18 (FIGS. 3 and 4) to external reagent sources via tubing. The external reagent inlet section 16 is adjacent to the valve section 14 and both sections 14, 16 are arranged between the reservoir body 29 and the sampling device 30 as shown for example in FIG. 1.

In an embodiment, the valve section 14 comprises a deflectable membrane layer 14*a* disposed on the microfluidic board 12. The microfluidic board 12 and deflectable membrane layer 14*a* may have essentially the same shape, for instance a substantially rectangular shape, or any other shape that optimizes the layout of the microfluidic network device, sampling device and reagent well/reagent connection sections for the intended biological sampling application.

The microfluidic network device 13 comprises a plurality of inlet channels 18 fluidly connected to respective wells 29*a* of the reservoir body 29 of the cartridge 10. Each inlet channel 18 comprises an inlet end 19 and an outlet end 20 interconnected fluidly by an intermediate channel section 21.

Figure 3:
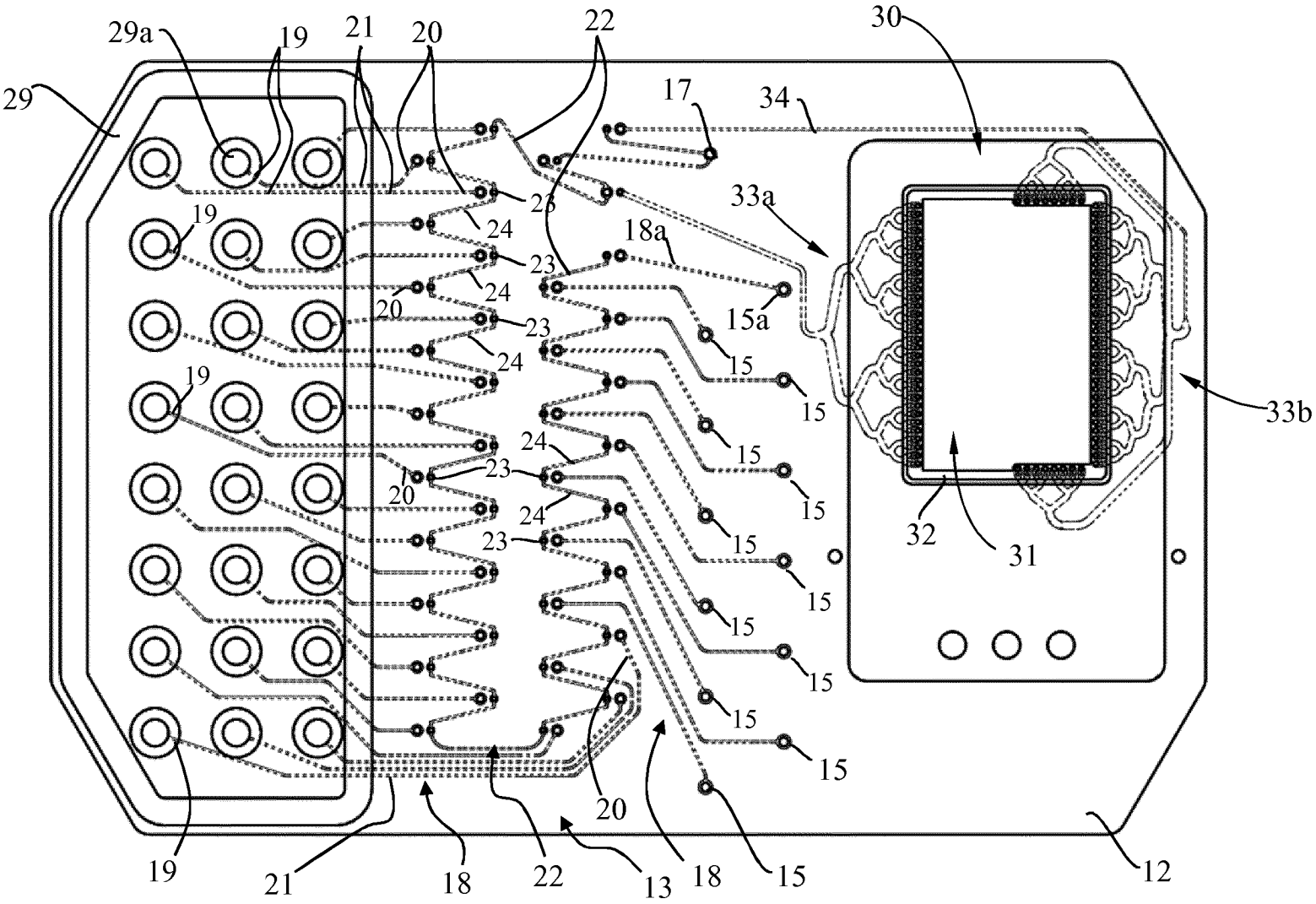
FIG. 3 is a top see-through view of the microfluidic cartridge of FIG. 1.
Figure 4:
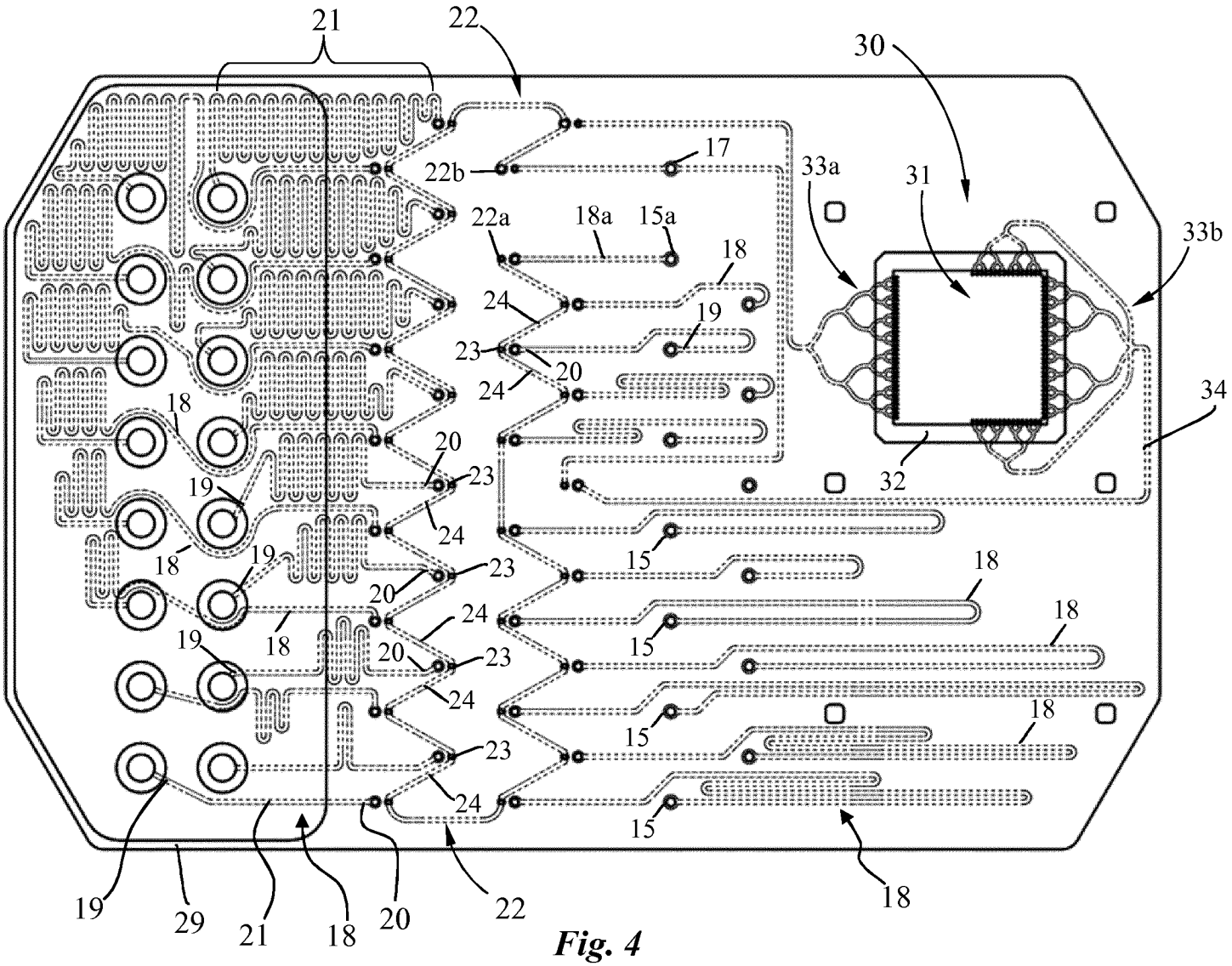
FIG. 4 is a top see-through view of a microfluidic cartridge according to another embodiment.

In a preferred embodiment, the microfluidic network device 13, as best illustrated in FIGS. 3 and 4, further comprises one reagent common outlet channel 22 that comprises a first and a second main part. Each main part comprises valve portions 23 and intermediate portion 24 therebetween. The valve portions 23 are positioned adjacent to the outlet ends 20 of the inlet channels 18 and the intermediate portion 24 are fluidly connected to each other in series. The outlet ends 20 of adjacent inlet channels 18 may be offset such that the plurality of outlet ends 20 are not formed along a linear line but along a zigzag or wave shaped line, or other oscillating line shapes. The first and second main parts of the reagent common outlet channel are thus proximate to the outlet end 20 of respective inlet channel 18 and both extend along a generally zigzag, wavy or oscillating path. The offset adjacent outlet ends 20 that form an oscillating arrangement when looking at the plurality of outlet ends 20 allows a more compact arrangement, namely a closer distance between adjacent inlet channels by providing more space at the outlet end 20 for positioning of a corresponding valve 25. The first and second main parts of the reagent common outlet channel 22 are spaced apart and extend generally in a direction transverse to the inlet channels 18, or at least the outlet end portion of the inlet channels. Valve portions 23 of the reagent common outlet channel 22 thus extend transversely to the outlet end portion 20 of the inlet channel in an essentially "T" shaped arrangement. The first main part of the reagent common outlet channel 22 is connectable to the inlet channels 18 fluidly connected to the wells 29*a* of the reservoir body 29 while the second main part of the reagent common outlet channel 22 is connectable to the inlet channels 18 fluidly connectable to external reagent sources.

Referring to FIGS. 8*a* and 8*b*, the valve may comprise a valve inlet orifice 26 formed at the outlet end 20 of the inlet channel, and a valve outlet orifice 27 above, or forming a portion of the reagent common outlet channel 22 and separated from the valve inlet orifice 26 by a valve separating wall portion 28. A deflectable member 25*a* extends over the valve inlet orifice 26, valve separating wall portion 28 and valve outlet orifice 27 such that when the deflectable member 25*a* is pressed against the valve separating wall portion 28, fluid communication between the valve inlet orifice 26 and valve outlet orifice 27 of the valve is prevented (i.e. the valve is in a closed position). It may be noted that the valve outlet orifice 27 of the valve may either be a small orifice extending to the outlet channel 22, but preferably forms part of the reagent common outlet channel 22. In the latter variant, when liquid flows through the reagent common outlet channel 22, the valve outlet orifice 27 of the valve 25 does not present any dead volume, and liquid in the valve outlet orifice is carried away by liquid flowing in the reagent common outlet channel 22.

In an embodiment, the deflectable member 25*a* may comprise an elastic membrane, for instance in the form or a sheet of elastically deformable material.

In a variant, the deflectable member 25*a* may comprise a spring mounted valve plate, plunger or ball (not shown), for example comprising a compression spring that pushes the plate, plunger or ball against the edges of the outlet and inlet orifices 26, 27.

It may be noted that the notion of valve inlet orifice 26 and valve outlet orifice 27 may comprise a single continuous orifice as illustrated in FIGS. 5*a* and 5*b* or a plurality of orifices (not shown). In particular, the valve inlet orifice, in view of its larger surface area, may be provided with a plurality of smaller orifices in order to provide better support for the deflectable member against the orifices, or to control the ratio of projected surface areas between the inlet and outlet.

In an embodiment, an outermost inlet channel 18*a* (FIGS. 3 and 4) may be connected to a washing solution that ensures that during washing, between application of different reagents, the outlet channel 22 is fully washed from one end 22*a* to the other end 22*b* to avoid contamination with liquids of a subsequent treatment cycle. In such an embodiment, the outermost inlet channel 18*a* at one end of the microfluidic network device connects an end 22*a* of the reagent common outlet channel 22 and the other end 22*b* of the outlet channel is connected to an outlet 17 of the microfluidic network device that may either be a waste line, a purge line, or a line connected to the sampling device.

The microfluidic network device 22 may therefore optionally comprise an outlet connected to the sampling device 30 as well as one or more purge or waste lines for expulsing liquid without going through the sampling device 30 or other device downstream of the device outlet, or for initial priming of the device during elimination of bubbles within the microfluidic network device.

In advantageous embodiments, the intermediate channel sections joining the inlet end 19 to the outlet end 20 of the inlet channels 18, may be provided with flow control portions 21. Flow control portions 21 may for instance comprise resistive channels that may be formed for instance by a serpentine channel configuration that slow the flow of fluid through the inlet channels.

The sampling device may further comprise suction holes 63 (see FIGS. 1 and 2) for open-chamber operation positioned near the sample processing chamber. These allow the draining of reagents and liquids injected into the microfluidic chamber 31 when the slide is not positioned thereon or when the slide is positioned in a non-sealed relation over the microfluidic chamber 31. The sampling device may further comprise suction holes 39*a*, 39*b*, 39*c*, 39*d* arranged at corners outside of the microfluidic chamber in fluid communication with first and second channels 38, 38' respectively for open-chamber operation. The first and second channels are connected to respective first and second outlets 38*a*, 38*b* that may be arranged in the valve section 14 and connectable to an outlet channel, in particular the common outlet channel.

In an embodiment, the microfluidic cartridge 10 as shown in FIGS. 6*a* and 6*b*, the sampling device 30 includes a first arrangement of reagents distribution comprising inlet and outlet distribution networks 33*a*, 33*b* arranged on two opposite sides of the microfluidic chamber 31 and a second arrangement of reagents distribution comprising inlet and outlet distribution networks 33*c*, 33*d* arranged on two other opposite sides of the microfluidic chamber 31. The first arrangement of reagents distribution is configured to direct flow of reagent(s) inside the microfluidic chamber 31 along a first direction, preferably in the longitudinal direction of the microfluidic chamber 31, while the second arrangement of the reagents distribution is configured to direct flow of reagent(s) inside the microfluidic chamber 31 in a second direction transverse to the first direction Different reagents may therefore flow along the first and second direction which are preferably orthogonal to each other. The width of the channels of the inlet distribution networks 33*c* of the second arrangement may be larger or smaller than the width of the channels of the outlet distribution networks 33*d* of the second arrangement. For instance, the width of the channels of the outlet distribution networks 33*d* of the second arrangement, may be larger than the width of the channels of the inlet distribution networks 33*c* of the second arrangement to accommodate the flow of materials such as waxy residues from fixated samples.

According to this embodiment, the various channels (e.g. inlet channels, reagent common outlet channel) of the microfluidic network device 13 and the channels of inlet and outlet distribution networks of the sampling device 30 of the microfluidic cartridge are grooved within the microfluidic board 12. The grooves may be produced in a surface of the microfluidic board 12 by additive (3D printing, material deposition techniques, molding, injection molding) or subtractive (machining) manufacturing techniques. For instance the microfluidic board may advantageously be an integrally formed plastic part in which the inlet channels, reagent common channel, and sampling device inlet and outlet distribution channels are formed by a molding die. The microfluidic cartridge may comprise a base layer plate or film covering the surface of the microfluidic board 12 over the grooved channels (e.g. inlet channels, reagent common outlet channel) of the microfluidic network device 13 in order to sealingly form the channels of the cartridge 10. The base layer may be welded, bonded or otherwise fixed against the board. The channels may also be formed integrally within a monolithic board by an additive manufacturing process.

In an embodiment (not shown), four distribution networks can be arranged according to a configuration using flow-directing valves on the cartridge, where the sampling device comprises three inlet distribution networks used to introduce reagents to the microfluidic chamber and one outlet distribution network used for collecting fluids from the microfluidic chamber 31.

Referring to FIG. 7, a biological sample processing system, according to an aspect of the invention, comprises a microfluidic cartridge of the type that has been described above and a microfluidic cartridge operating system. The operating system comprises a cartridge receptacle 60 receiving the microfluidic cartridge 10, a valve interfacing assembly 45 and a reservoir body interfacing assembly 50 which are in fluid communication with an external pressure source.

In an embodiment, the valve interfacing assembly comprises a pressure delivery manifold head 45 displaceable relative to the cartridge receptacle 60 from a non-operating configuration to an operating configuration in which the bottom face of the manifold head 45 lies against the valve section 14 of the microfluidic network device 13 (FIGS. 8*a* and 8*b*). The manifold head 45 comprises a plurality of actuation chambers 46 and corresponding actuation lines 47 in fluid communication with each actuation chamber. The plurality of actuation chambers 46 is disposed such that each chamber encloses the valve inlet and outlet orifices 26, 27 of the corresponding valve. The pressure delivery manifold head 45 is operable to selectively create a negative pressure inside one or more actuation chambers 46 in order to deflect the deflectable member 25*a* of one or more valves 25 to create a fluid communication between at least one inlet channel 18 and the reagent common outlet channel 22 as shown in FIG. 8*b*. In a variant, it is also possible that the deflectable member 25*a* has a positive elastic pressure against the outlet, inlet and valve separating wall portions and the valve opening is actuated by an under-pressure in the actuation chamber 46.

In a variant, the microfluidic operating system may control the valves by other means, for instance by electromagnetic, piezoelectric, hydraulic means that act on the deflectable member, for instance to press on the deflectable member to close the valve, or to release or to lift up the deflectable member, to open the valve.

In an embodiment, the reservoir body interfacing assembly comprises a pressure delivery manifold head 50 (FIGS. 7 and 10) displaceable relative to the cartridge receptacle 60 from a non-operating configuration to an operating configuration, in which the bottom face of the manifold head lies against the top face of the reservoir body 29. The manifold head 50 comprises a plurality of actuation lines 51 disposed to be aligned with the plurality of wells 29*a* to induce flow of a reagent from one or more wells 29*a* into the microfluidic chamber 31 of the sampling device 30. A sealing gasket 52 is arranged against the bottom face of the manifold head 50 and is and configured to surround each outlet of the actuation lines 51 to ensure that the manifold head is sealingly fitted against the top face of the reservoir body 29 when the processing system is in an operating configuration. The actuation lines may provide a constant pressure, whereby the valves 25 are individually selectively operable to selectively control flow of reagent in a corresponding inlet channel 18.

In a variant, the actuation lines 51 may be individually selectively pressurized to selectively induce flow of reagent in a corresponding inlet channel 18.

In an embodiment, the microfluidic cartridge operating system of the biological sample processing system further comprises an external reagent interfacing assembly comprising a reagent delivery manifold head 55 operably connected to external sources of reagents. As shown in FIG. 9, the reagent delivery manifold head 55 comprises a plurality of reagent delivery lines 56 containing each a sealing, for instance in the form of an O-ring 57, disposed around the outlet portion of the delivery lines. The sealing may also be provided in the form of a gasket, similar to the configuration of FIG. 10, between the manifold head 55 and the microfluidic support 12. The delivery lines 56 of the reagent manifold head 55 are therefore configured to be sealingly coupled to the corresponding reagent inlet couplings 16*a* of the external reagent inlet section 16 of the microfluidic cartridge 10.

The microfluidic cartridge operating system also comprises a clamping actuator 41 configured to apply a clamping force against the sample support (e.g. a standard microscope slide) to form an airtight microfluidic chamber for sample processing.

In an embodiment, the cartridge receptacle 60 receiving the microfluidic cartridge 10 may be actuated in a vertical direction, for example by a piston driven mechanism, against the clamping actuator 41, the pressure delivery manifold heads 45, 50, and the reagent delivery manifold head 55. Biased elements, for example compression springs 42, 43, 44, are operably coupled, at one end, to respective manifold heads 45, 50, 55, and, at the other end, to a support. These compression springs 42, 43, 44 may be preloaded according to a preset value by adjusting the position of the manifold heads. The force applied by each manifold head against the corresponding sections of the microfluidic cartridge 10 may therefore be fine-tuned by adjusting the force applied by the piston driven mechanism when the microfluidic cartridge 10 is in contact with the different manifold heads and the force applied by the compression springs of each manifold head.

List of references used

- biological sample processing system
  - microfluidic cartridge 10
    - microfluidic support 12
      - microfluidic board
    - microfluidic network device 13
      - valve section 14
        - deflectable membrane layer 14a
      - device inlets 15
        - washing inlet 15a
        - external reagent inlet section 16
          - reagent inlet couplings 16a
      - cartridge outlet 17
      - fluid channels
        - inlet channels 18
          - washing inlet channel 18a
          - inlet end portion 19
          - outlet end portion 20
          - intermediate channel section
            - flow control portion 21 (resistive, e.g. serpentine portion)
        - reagent common outlet channel 22
          - inlet end 22a
          - outlet end 22b
          - valve portion 23
          - intermediate portion 24
    - valve 25
      - deflectable member 25a -continued

| List of references used |
|---|
| valve inlet orifice 26 |
| valve outlet orifice 27 |
| valve separating wall portion 28 |
| onboard reservoirs |
| reservoir body 29 |
| wells 29a |
| sampling device 30 |
| microfluidic chamber 31 |
| sealing ring 32 |
| first arrangement of reagents distribution |
| inlet distribution network 33a |
| outlet distribution network 33b |
| second arrangement of reagents distribution |
| inlet distribution network 33c |
| outlet distribution network 33d |
| chamber outlet channel 34 |
| slide holder 35 |
| clamping system 36 |
| clips 36a |
| guiding arrangement 37 |
| rails |
| Open chamber fluid outlet system |
| outlets 38a, 38b |
| suction holes 39a, 39b, 39c, 39d |
| channels 38, 38' |
| suction holes 63 |
| microfluidic cartridge operating system |
| external reagent sources |
| reagent tubes |
| operating system bench 40 |
| actuators |
| clamping actuator 41 |
| piston driven actuator |
| reservoir body interfacing actuator 43 |
| biasing elements |
| compression springs |
| valve interfacing assembly |
| biasing elements 42 |
| compression springs |
| pressure delivery manifold head 45 |
| actuation chamber 46 |
| actuation line 47 |
| reservoir body interfacing assembly |
| biasing elements 43 |
| compression springs |
| pressure delivery manifold head 50 |
| actuation lines 51 |
| sealing member |
| gasket 52 |
| external reagent interfacing assembly |
| biasing elements 44 |
| compression springs |
| reagent delivery manifold head 55 |
| reagent delivery line 56 |
| sealing 57 |
| O-ring |
| cartridge receptacle 60 |

The invention claimed is:

1. A biological sample processing system comprising a microfluidic cartridge, the microfluidic cartridge comprising:

a sampling device having a sealing ring arranged to form a microfluidic chamber when a support containing a biological sample fixed thereon is brought into contact with the sealing ring, and a microfluidic network device configured to supply reagents to the microfluidic chamber, the sampling device further comprising inlet and outlet distribution networks in fluid communication with the microfluidic chamber and a slide holder to guide and position said support containing a biological sample on the sampling device, the microfluidic network device comprising a plurality of reagent inlet channels fluidly connectable to reagent sources, at least one reagent outlet channel fluidly connected to the sampling device inlet distribution network and a plurality of valves operable to selectively connect the inlet channels to the at least one outlet channel, wherein the sampling device and microfluidic network device are formed on a common microfluidic support as a single part;

the biological sample processing system further comprising a microfluidic cartridge operating system comprising a cartridge receptacle receiving the microfluidic cartridge, a valve interfacing assembly and a reservoir body interfacing assembly, wherein the valve interfacing assembly is operable to selectively actuate each valve to create a fluid communication between a corresponding inlet channel and the reagent outlet channel;

wherein the reservoir body interfacing assembly is configured to induce flow of a reagent from one or more wells into the microfluidic chamber of the sampling device.

2. Microfluidic cartridge according to the claim 1, further comprising a reagent reservoir body formed in the microfluidic support containing a plurality of wells configured to be filled with reagents, wherein each well is fluidly connected to a corresponding inlet channel.

3. Microfluidic cartridge according to claim 1, wherein the sampling device comprises a first arrangement of reagents distribution comprising inlet and outlet distribution networks arranged on two opposite sides of the microfluidic chamber and configured to direct flow of reagent(s) inside the microfluidic chamber along a first direction, and a second arrangement of reagents distribution comprising inlet and outlet distribution networks arranged on two other opposite sides of the microfluidic chamber and configured to direct flow of reagent(s) inside the microfluidic chamber in a second direction transverse to the first direction.

4. Microfluidic cartridge according to claim 1, wherein the microfluidic support comprises an integrally formed plastic molded microfluidic board in which the inlet channels, outlet channel, and sampling device inlet and outlet distribution channels are formed.

5. Microfluidic cartridge according to claim 1, wherein the at least one reagent outlet channel is a common single outlet channel connected to a plurality of said reagent inlet channels, said outlet channel comprising valve portions and intermediate portions therebetween, wherein the valve portions are adjacent to outlet end portions of the inlet channels and the intermediate portions are fluidly connected to each other in series, and wherein each of said plurality of valves interconnect an outlet end portion of each inlet channel to a corresponding valve portion of the common reagent outlet channel, wherein each valve is switchable between a valve closed position in which fluid communication between a corresponding inlet channel and the reagent common outlet channel is closed, and a valve open position in which fluid communication between said inlet channel and the reagent common outlet channel is open.

6. Microfluidic cartridge according to claim 5, wherein the common reagent outlet channel extends generally in a direction transverse to an outlet end portion of the inlet channels.

7. Microfluidic cartridge according to claim 5, wherein the reagent common outlet channel comprises a first and a second main part which are spaced apart and extend in a direction transverse to an outlet end portion of the inlet channels.

8. Microfluidic cartridge according to claim 1, wherein the microfluidic network device further comprises an external reagent inlet section comprising several reagent inlet couplings for fluidly coupling one or more external reagent inlet channels to external reagent sources.

9. Microfluidic cartridge according to claim 8, wherein the external reagent inlet section is adjacent to a valve section comprising the plurality of valves.

10. The biological sample processing system according to claim 9, further comprising an onboard reagent reservoir body formed in the microfluidic support containing a plurality of wells configured to be filled with reagents, wherein each well is fluidly connected to a corresponding inlet channel, wherein the valve section is positioned between the external reagent inlet section and the onboard reagent reservoir body.

11. Microfluidic cartridge according to claim 1 wherein the sampling device is positioned adjacent a first end of the microfluidic support.

12. Microfluidic cartridge according to claim 10, wherein the onboard reagent reservoir body is positioned adjacent a second end of the microfluidic support opposite the first end.

13. Microfluidic cartridge according to claim 1, wherein the microfluidic network device further comprises a cartridge outlet, a chamber outlet channel connected to the outlet distribution network of the sampling device, and at least two valves configured to fluidly interconnect respectively the chamber outlet channel or the reagent common outlet channel to the cartridge outlet in order to discharge the reagent residues coming from the microfluidic chamber of the sampling device during sample processing steps or to discharge washing solutions circulating through the reagent common outlet channel during a washing step.

14. Microfluidic cartridge according to claim 1, further comprising a reagent reservoir body formed in the microfluidic support containing a plurality of wells configured to be filled with reagents, wherein each well is fluidly connected to a corresponding inlet channel, wherein the microfluidic network device is at least partly embedded inside the microfluidic board on a first side thereof, while the sealing ring of the sampling device and the onboard reservoir body are mounted on a second side of said microfluidic board opposite the first side.

15. Microfluidic cartridge according to claim 1, wherein a valve section comprises the plurality of valves, the valve section comprising a deflectable membrane layer disposed on the microfluidic board.

16. Biological sample processing system according to claim 1, further comprising a reagent reservoir body formed in the microfluidic support containing a plurality of wells configured to be filled with reagents.

17. Biological sample processing system according to claim 1, wherein the reservoir body interfacing assembly comprises a delivery manifold head displaceable relative to the cartridge receptacle from a non-operating configuration to an operating configuration, in which the bottom face of the manifold head lies against the top face of the reservoir body, wherein the manifold head comprises a plurality of actuation lines disposed to be aligned with the plurality of wells.

18. Biological sample processing system according to claim 1, wherein the valve interfacing assembly and the body reservoir interfacing assembly are in fluid communication with an external pressure source.

19. Biological sample processing system according to claim 18, wherein the valve interfacing assembly comprises a pressure delivery manifold head displaceable relative to the cartridge receptacle from a non-operating configuration to an operating configuration in which the bottom face of the manifold head lies against the valve section or multiple valve sections of the microfluidic network device, wherein the manifold head comprises a plurality of actuation chambers and corresponding actuation lines in fluid communication with each actuation chamber, the plurality of actuation chambers being disposed such that each chamber encloses the valve inlet and outlet orifices of the corresponding valve, wherein the pressure delivery manifold head is operable to selectively create a negative pressure inside one or more actuation chambers.

20. Biological sample processing system according to claim 1, wherein a sealing gasket is arranged against the bottom face of said pressure delivery manifold head and is configured to surround each outlet of the actuation lines to ensure that the manifold head of the second fluidic interfacing assembly is sealingly fitted against the top face of reservoir body when the processing system is in an operating configuration.

21. Biological sample processing system according to claim 1, wherein the microfluidic network device further comprises an external reagent inlet section comprising several reagent inlet couplings for coupling one or more inlet channels to external reagent sources, and wherein the microfluidic cartridge operating system further comprises an external reagent interfacing assembly comprises a reagent delivery manifold head operably connected to external sources of reagents, said reagent delivery manifold head comprising a plurality of reagent delivery lines disposed to be sealingly fitted with the corresponding reagent inlet couplings.

22. A biological sample processing system comprising a microfluidic cartridge, the microfluidic cartridge comprising:

a sampling device having a sealing ring arranged to form a microfluidic chamber when a support containing a biological sample fixed thereon is brought into contact with the sealing ring, and a microfluidic network device configured to supply reagents to the microfluidic chamber, the sampling device further comprising inlet and outlet distribution networks in fluid communication with the microfluidic chamber and a slide holder to guide and position said support containing a biological sample on the sampling device, the microfluidic network device comprising a plurality of reagent inlet channels fluidly connectable to reagent sources, at least one reagent outlet channel fluidly connected to the sampling device inlet distribution network and a plurality of valves operable to selectively connect the inlet channels to the at least one outlet channel, wherein the sampling device and microfluidic network device are formed on a common microfluidic support as a single part;

the biological sample processing system further comprising a microfluidic cartridge operating system comprising a cartridge receptacle receiving the microfluidic cartridge and a valve interfacing assembly;

wherein the valve interfacing assembly comprises a pressure delivery manifold head displaceable relative to the cartridge receptacle from a non-operating configuration to an operating configuration in which the bottom face of the manifold head lies against the valve section or multiple valve sections of the microfluidic network device, wherein the manifold head comprises a plurality of actuation chambers and corresponding actuation lines in fluid communication with each actuation chamber, the plurality of actuation chambers being disposed such that each chamber encloses the valve inlet and outlet orifices of the corresponding valve, wherein the pressure delivery manifold head is operable to selectively create a negative pressure inside one or more actuation chambers.

23. The biological sample processing system according to claim 22, further comprising an onboard reagent reservoir body formed in the microfluidic support containing a plurality of wells configured to be filled with reagents, wherein each well is fluidly connected to a corresponding inlet channel.

24. The biological sample processing system according to claim 22, wherein the sampling device comprises a first arrangement of reagents distribution comprising inlet and outlet distribution networks arranged on two opposite sides of the microfluidic chamber and configured to direct flow of reagent(s) inside the microfluidic chamber along a first direction, and a second arrangement of reagents distribution comprising inlet and outlet distribution networks arranged on two other opposite sides of the microfluidic chamber and configured to direct flow of reagent(s) inside the microfluidic chamber in a second direction transverse to the first direction.

25. The biological sample processing system according to claim 22, wherein the microfluidic support comprises an integrally formed plastic molded microfluidic board in which the inlet channels, outlet channel, and sampling device inlet and outlet distribution channels are formed.

26. The biological sample processing system according to claim 22, wherein the at least one reagent outlet channel is a common single outlet channel connected to a plurality of said reagent inlet channels, said outlet channel comprising valve portions and intermediate portions therebetween, wherein the valve portions are adjacent to outlet end portions of the inlet channels and the intermediate portions are fluidly connected to each other in series, and wherein each of said plurality of valves interconnect an outlet end portion of each inlet channel to a corresponding valve portion of the common reagent outlet channel, wherein each valve is switchable between a valve closed position in which fluid communication between a corresponding inlet channel and the reagent common outlet channel is closed, and a valve open position in which fluid communication between said inlet channel and the reagent common outlet channel is open.

27. The biological sample processing system according to claim 26, wherein the common reagent outlet channel extends generally in a direction transverse to an outlet end portion of the inlet channels.

28. The biological sample processing system according to claim 26, wherein the reagent common outlet channel comprises a first and a second main part which are spaced apart and extend in a direction transverse to an outlet end portion of the inlet channels.

29. The biological sample processing system according to claim 22, wherein the microfluidic network device further comprises an external reagent inlet section comprising several reagent inlet couplings for fluidly coupling one or more external reagent inlet channels to external reagent sources.

30. The biological sample processing system according to claim 29, wherein the external reagent inlet section is adjacent to a valve section comprising the plurality of valves.

31. The biological sample processing system according to claim 30, further comprising an onboard reagent reservoir body formed in the microfluidic support containing a plurality of wells configured to be filled with reagents, wherein each well is fluidly connected to a corresponding inlet channel, wherein the valve section is positioned between the external reagent inlet section and the onboard reagent reservoir body.

32. The biological sample processing system according to claim 22, wherein the sampling device is positioned adjacent a first end of the microfluidic support.

33. The biological sample processing system according to claim 31, wherein the onboard reagent reservoir body is positioned adjacent a second end of the microfluidic support opposite the first end.

34. The biological sample processing system according to claim 22, wherein the microfluidic network device further comprises a cartridge outlet, a chamber outlet channel connected to the outlet distribution network of the sampling device, and at least two valves configured to fluidly interconnect respectively the chamber outlet channel or the reagent common outlet channel to the cartridge outlet in order to discharge the reagent residues coming from the microfluidic chamber of the sampling device during sample processing steps or to discharge washing solutions circulating through the reagent common outlet channel during a washing step.

35. The biological sample processing system according to claim 23, further comprising an onboard reagent reservoir body formed in the microfluidic support containing a plurality of wells configured to be filled with reagents, wherein each well is fluidly connected to a corresponding inlet channel, wherein the microfluidic network device is at least partly embedded inside the microfluidic board on a first side thereof, while the sealing ring of the sampling device and the onboard reservoir body are mounted on a second side of said microfluidic board opposite the first side.

36. The biological sample processing system according to claim 22, wherein a valve section comprises the plurality of valves, the valve section comprising a deflectable membrane layer disposed on the microfluidic board.

37. The biological sample processing system according to claim 22, wherein the valve interfacing assembly is operable to selectively actuate each valve to create a fluid communication between a corresponding inlet channel and the reagent outlet channel.

38. The biological sample processing system according to claim 22, further comprising a reagent reservoir body formed in the microfluidic support containing a plurality of wells configured to be filled with reagents, wherein each well is fluidly connected to a corresponding inlet channel, wherein the reservoir body interfacing assembly is operable to induce flow of a reagent from one or more wells into the microfluidic chamber the sampling device.

39. The biological sample processing system according to claim 22, wherein the valve interfacing assembly and the body reservoir interfacing assembly are in fluid communication with an external pressure source.

40. The biological sample processing system according to claim 22, wherein a sealing gasket is arranged against the bottom face of said pressure delivery manifold head and is configured to surround each outlet of the actuation lines to ensure that the manifold head of the second fluidic interfacing assembly is sealingly fitted against the top face of reservoir body when the processing system is in an operating configuration.

41. The biological sample processing system according to claim 22, wherein the microfluidic network device further comprises an external reagent inlet section comprising several reagent inlet couplings for coupling one or more inlet channels to external reagent sources, and wherein the microfluidic cartridge operating system further comprises an external reagent interfacing assembly comprises a reagent delivery manifold head operably connected to external sources of reagents, said reagent delivery manifold head comprising a plurality of reagent delivery lines disposed to be sealingly fitted with the corresponding reagent inlet couplings.

42. A biological sample processing system comprising a microfluidic cartridge, the microfluidic cartridge comprising:

a sampling device having a sealing ring arranged to form a microfluidic chamber when a support containing a biological sample fixed thereon is brought into contact with the sealing ring, and a microfluidic network device configured to supply reagents to the microfluidic chamber, the sampling device further comprising inlet and outlet distribution networks in fluid communication with the microfluidic chamber and a slide holder to guide and position said support containing a biological sample on the sampling device, the microfluidic network device comprising a plurality of reagent inlet channels fluidly connectable to reagent sources, at least one reagent outlet channel fluidly connected to the sampling device inlet distribution network and a plurality of valves operable to selectively connect the inlet channels to the at least one outlet channel, wherein the sampling device and microfluidic network device are formed on a common microfluidic support as a single part;

the biological sample processing system further comprising a microfluidic cartridge operating system comprising a cartridge receptacle receiving the microfluidic cartridge and a valve interfacing assembly;

wherein the microfluidic network device further comprises an external reagent inlet section comprising several reagent inlet couplings for coupling one or more inlet channels to external reagent sources, and wherein the microfluidic cartridge operating system further comprises an external reagent interfacing assembly comprises a reagent delivery manifold head operably connected to external sources of reagents, said reagent delivery manifold head comprising a plurality of reagent delivery lines disposed to be sealingly fitted with the corresponding reagent inlet couplings.

43. The biological sample processing system according to claim 42, further comprising an onboard reagent reservoir body formed in the microfluidic support containing a plurality of wells configured to be filled with reagents, wherein each well is fluidly connected to a corresponding inlet channel.

44. The biological sample processing system according to claim 42, wherein the sampling device comprises a first arrangement of reagents distribution comprising inlet and outlet distribution networks arranged on two opposite sides of the microfluidic chamber and configured to direct flow of reagent(s) inside the microfluidic chamber along a first direction, and a second arrangement of reagents distribution comprising inlet and outlet distribution networks arranged on two other opposite sides of the microfluidic chamber and configured to direct flow of reagent(s) inside the microfluidic chamber in a second direction transverse to the first direction.

45. The biological sample processing system according to claim 42, wherein the microfluidic support comprises an integrally formed plastic molded microfluidic board in which the inlet channels, outlet channel, and sampling device inlet and outlet distribution channels are formed.

46. The biological sample processing system according to claim 42, wherein the at least one reagent outlet channel is a common single outlet channel connected to a plurality of said reagent inlet channels, said outlet channel comprising valve portions and intermediate portions therebetween, wherein the valve portions are adjacent to outlet end portions of the inlet channels and the intermediate portions are fluidly connected to each other in series, and wherein each of said plurality of valves interconnect an outlet end portion of each inlet channel to a corresponding valve portion of the common reagent outlet channel, wherein each valve is switchable between a valve closed position in which fluid communication between a corresponding inlet channel and the reagent common outlet channel is closed, and a valve open position in which fluid communication between said inlet channel and the reagent common outlet channel is open.

47. The biological sample processing system according to claim 46, wherein the common reagent outlet channel extends generally in a direction transverse to an outlet end portion of the inlet channels.

48. The biological sample processing system according to claim 46, wherein the reagent common outlet channel comprises a first and a second main part which are spaced apart and extend in a direction transverse to an outlet end portion of the inlet channels.

49. The biological sample processing system according to claim 43, wherein the external reagent inlet section is adjacent to a valve section comprising the plurality of valves.

50. The biological sample processing system according to claim 49, further comprising an onboard reagent reservoir body formed in the microfluidic support containing a plurality of wells configured to be filled with reagents, wherein each well is fluidly connected to a corresponding inlet channel, wherein the valve section is positioned between the external reagent inlet section and the onboard reagent reservoir body.

51. The biological sample processing system according to claim 42, wherein the sampling device is positioned adjacent a first end of the microfluidic support.

52. The biological sample processing system according to claim 50 wherein the onboard reagent reservoir body is positioned adjacent a second end of the microfluidic support opposite the first end.

53. The biological sample processing system according to claim 42, wherein the microfluidic network device further comprises a cartridge outlet, a chamber outlet channel connected to the outlet distribution network of the sampling device, and at least two valves configured to fluidly interconnect respectively the chamber outlet channel or the reagent common outlet channel to the cartridge outlet in order to discharge the reagent residues coming from the microfluidic chamber of the sampling device during sample processing steps or to discharge washing solutions circulating through the reagent common outlet channel during a washing step.

54. The biological sample processing system according to claim 42, further comprising an onboard reagent reservoir body formed in the microfluidic support containing a plurality of wells configured to be filled with reagents, wherein each well is fluidly connected to a corresponding inlet channel, wherein the microfluidic network device is at least partly embedded inside the microfluidic board on a first side thereof, while the sealing ring of the sampling device and the onboard reservoir body are mounted on a second side of said microfluidic board opposite the first side.

55. The biological sample processing system according to claim 42, wherein a valve section comprises the plurality of valves, the valve section comprising a deflectable membrane layer disposed on the microfluidic board.

56. The biological sample processing system according to claim 42, further comprising a microfluidic cartridge operating system comprising a cartridge receptacle receiving the microfluidic cartridge, a valve interfacing assembly and a reservoir body interfacing assembly, wherein the valve interfacing assembly is operable to selectively actuate each valve to create a fluid communication between a corresponding inlet channel and the reagent outlet channel.

57. The biological sample processing system according to claim 56, further comprising a reagent reservoir body formed in the microfluidic support containing a plurality of wells configured to be filled with reagents, wherein each well is fluidly connected to a corresponding inlet channel, wherein the reservoir body interfacing assembly is operable to induce flow of a reagent from one or more wells into the microfluidic chamber the sampling device.

58. The biological sample processing system according to claim 57, wherein the reservoir body interfacing assembly comprises a delivery manifold head displaceable relative to the cartridge receptacle from a non-operating configuration to an operating configuration, in which the bottom face of the manifold head lies against the top face of the reservoir body, wherein the manifold head comprises a plurality of actuation lines disposed to be aligned with the plurality of wells.

59. The biological sample processing system according to claim 56, wherein the valve interfacing assembly and the body reservoir interfacing assembly are in fluid communication with an external pressure source.

60. The biological sample processing system according to claim 59, wherein the valve interfacing assembly comprises a pressure delivery manifold head displaceable relative to the cartridge receptacle from a non-operating configuration to an operating configuration in which the bottom face of the manifold head lies against the valve section or multiple valve sections of the microfluidic network device, wherein the manifold head comprises a plurality of actuation chambers and corresponding actuation lines in fluid communication with each actuation chamber, the plurality of actuation chambers being disposed such that each chamber encloses the valve inlet and outlet orifices of the corresponding valve, wherein the pressure delivery manifold head is operable to selectively create a negative pressure inside one or more actuation chambers.

61. The biological sample processing system according to claim 60, wherein a sealing gasket is arranged against the bottom face of said pressure delivery manifold head and is configured to surround each outlet of the actuation lines to ensure that the manifold head of the second fluidic interfacing assembly is sealingly fitted against the top face of reservoir body when the processing system is in an operating configuration.

* * * * *